US005794907A

United States Patent [19]

Bellia

[11] Patent Number: 5,794,907

[45] Date of Patent: Aug. 18, 1998

[54] JACK SUPPORT

[76] Inventor: Joseph C. Bellia, 217 Hazel Dr., Pittsburgh, Pa. 15228

[21] Appl. No.: 627,885

[22] Filed: Apr. 3, 1996

[51] Int. Cl.[6] ..... A47F 5/00

[52] U.S. Cl. ..... 248/354.7; 248/352; 254/8 B

[58] Field of Search ..... 248/354.7, 297.31, 248/297.51, 354.6, 354.5, 644, 623, 161, 407, 408, 409, 411, 412, 423, 188.2, 188.5, 188.91, 352, 354.1; 292/338, 339; 254/8 B

[56] References Cited

U.S. PATENT DOCUMENTS

| | | | |
|---|---|---|---|
| 1,455,617 | 5/1923 | Jackson | 248/354.7 X |
| 2,611,579 | 9/1952 | Guzey et al. | 254/8 B |
| 3,173,644 | 3/1965 | Burfiend | 248/354.6 |
| 4,008,778 | 2/1977 | Mitchell | 254/8 B |
| 4,501,561 | 2/1985 | Speelman | 248/354.5 X |
| 4,650,427 | 3/1987 | Huchinson | 248/354.5 X |
| 5,221,073 | 6/1993 | Shockley | 254/8 B |
| 5,323,997 | 6/1994 | Danaj | 248/354.7 |
| 5,520,030 | 5/1996 | Muldoon | 248/352 |
| 5,575,492 | 11/1996 | Stone | 248/351 |

FOREIGN PATENT DOCUMENTS

| | | | |
|---|---|---|---|
| 466550 | 12/1968 | Switzerland | 248/354.5 |
| 2034408 | 6/1980 | United Kingdom | 254/8 B |

*Primary Examiner*—Leslie A. Braun
*Assistant Examiner*—Gwendolyn W. Baxter

[57] ABSTRACT

An adjustable mechanical device to engage the opening of a standard hydraulic floor jack to prevent said jack from lowering inadvertently in the event of hydraulic failure. Said device is installed by positioning as shown with L-clip under jack axle, and with adjustable strut extended so as to engage the upper shaft of jack. To remove the jack support, the lever is lifted wherein the pawl is disengaged, the strut lowers, and the Jack Support is removed.

3 Claims, 1 Drawing Sheet

JACK SUPPORT

BACKGROUND—FIELD OF INVENTION

This invention relates to automotive maintenance, specifically to hydraulic floor jacks and a means of supporting same.

BACKGROUND—DESCRIPTION OF PRIOR ART

When using hydraulic floor jacks, the mechanic has the option of a) using jack stands under the vehicle, b) using nothing and risking personal injury or c) using blocks of wood or something similar as a makeshift support.

A preliminary search of prior art indicated several jack support devices albeit nothing which embodies the specific features of the invention described herein.

U.S. Pat. No. 4,221,363 to Jasper (1980) discloses what is essentially a floor jack as commonly used in room and pillar coal mining, and having no relevance here.

U.S. Pat. No. 4,221,362 to Van Santen (1980) discloses a tube within a tube floor jack as commonly used to shore up residential floor joists, etc., and again has no relevance here.

U.S. Pat. No. 4,690,365 to Miller et al (1987) describes a localized clamping device which apparently was used in the aerospace industry and not relevant here.

U.S. Pat. No. 3,870,278 to Booker & Kump (1975) discloses another tube within a tube design within integral slots to engage a locking pin and appears intended for non-automotive applications and, again, is not relevant.

U.S. Design Patent No. 357,787 to Sullivan (1995) shows a tube within a tube device with a pin affixed to lower portion engaging holes on the inner tube, a design discarded by the inventor as being too unwieldly to use in practice.

Therefore, one would determine, after a thorough evaluation of the above described prior art, that insofar as the patents cited, and if in fact the patents cited do constitute the toad body of related prior are, that the invention described herein does, in fact, demonstrate novelty and unobviousness.

OBJECTS AND ADVANTAGES

Accordingly, besides the objects and advantage of the Jack Support described in my above patent, several objects and advantages of the present invention are:

(a) to provide a support which can be used with one hand.

(b) to provide a support which is quick to use.

(c) to provide a support which is adjustable for variable jack openings.

(d) to provide a support which promotes operator safety.

Further objects and advantages will become apparent from a consideration of the ensuing description and drawings.

DRAWING FIGURES

Figure 2:
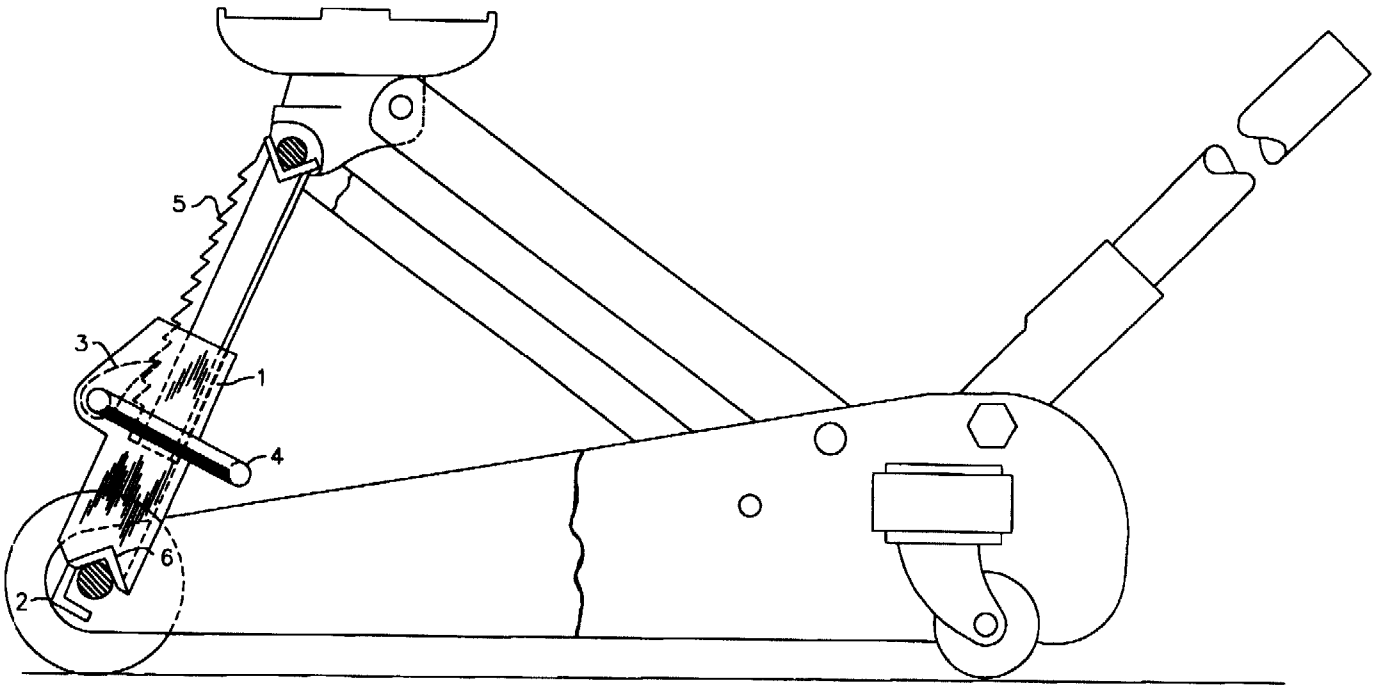
FIG. 2 shows an end elevation of the above.

| Reference Numeral in Drawings | |
|---|---|
| 1 main body | 4 lever |
| 2 bottom clip | 5 extendable strut |
| 3 pawl | 6 inverted V member |

DESCRIPTION FIGS. 1 AND 2

Figure 1:
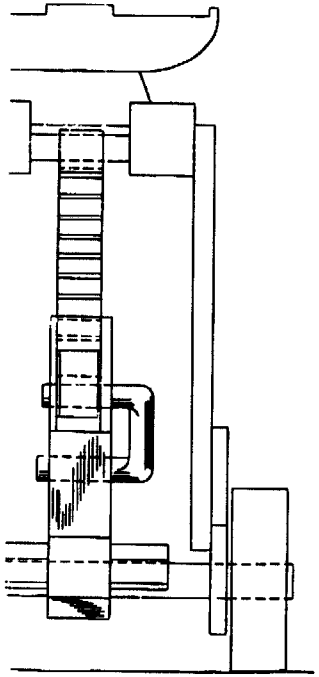
FIG. 1 shows a side elevation of the Jack Support typically installed in a standard hydraulic floor jack.

A typical embodiment of the Jack Support of the present invention is illustrated in FIG. 1 (side view) and FIG. 2 (end view). The Jack Support consists of a main hollow body 1, incorporating an integral pivoting pawl 3, with an associated release lever 4. The lower end of said body incorporates a L-clip 2 which engages the main axle of the floor jack. Further, the bottom of the main body 1 incorporates a laterally elongated inverted concave member 6 to distribute the load along said axle.

In addition to said body 1, there is a moveable, adjustable, toothed inner strut 5 which is used to extend the Jack Support to fit the variable opening of the floor jack. At the top of said inner member 5 is an inverted v-notch used to engage the upper shaft of the floor jack.

OPERATION—FIGS. 1 AND 2

The manner of using the Jack Support to engage an elevated floor jack is to insert said support into the variable floor jack opening, sliding the L-clip 6 under the floor jack bottom axle, using one's right or left hand to vertically extend strut 5 so as to engage the upper shaft on the floor jack.

To remove the Jack Support, one simply lifts the lever 4 causing the pawl 3 to disengage the mating teeth on strut 5, allowing said strut to fall into the main body 1. The Jack Support is then removed and stored for future use.

SUMMARY, RAMIFICATIONS, AND SCOPE

Accordingly, the reader will see that the embodiment of this invention can be used quickly and with one hand to provide a totally safe working environment when using a standard hydraulic floor jack.

While the description above contains certain specificities, these should not be construed as limiting the scope of the invention but as merely providing illustrations of some of the presently preferred embodiments of this invention. For example, the Jack Support device could utilize a right-hand/left-hand turnbuckle-style mechanism, a single right-hand thread extension strut with an upper slip collar, or could conceiveably be incorporated integral with the hydraulic floor jack and supplied by the original equipment manufacturer (O.E.M.).

Thus the scope of the invention should be determined by the appended claims and their legal equivalents, rather by the examples given.

I claim:

1. In combination, a standard hydraulic floor jack with a detachable safety jack support to prevent said jack from lowering inadvertently in the event of a hydraulic failure, wherein said jack includes a main wheel bottom axle and an upper support shaft which moves in variable vertical spaced relationship to said bottom axle when said jack is operated, said jack support comprised of an extensible and contractible body having a lower end with an upper strut which adjustably raises and lowers relative to said lower end, a concave notch configuration on an upper end of said strut and on a bottom end of said lower end for respectively engaging and nesting with said upper and bottom jack shafts, said notch configuration on said bottom end further including a c-clip for guiding said bottom notch configuration on to said bottom axle.

2. The combination of claim 1, wherein said bottom notch configuration is elongated for distributing load on said bottom axle.

3. The combination of claim 1, wherein said jack support includes a vertical series of teeth on said strut and a pivotable pawl on said lower end for engaging said teeth at desired adjustable positions.

* * * * *